United States Patent [19]

Worrix

[11] 4,090,047

[45] May 16, 1978

[54] CENTER BREAK DISCONNECT SWITCH ASSEMBLY

[75] Inventor: Matthew L. Worrix, Sheridan, Oreg.

[73] Assignee: Allis-Chalmers Corporation, Milwaukee, Wis.

[21] Appl. No.: 722,108

[22] Filed: Sep. 10, 1976

[51] Int. Cl.[2] ..... H01H 31/00

[52] U.S. Cl. ..... 200/48 P; 200/48 CB; 200/48 R; 308/189 R; 339/2 A; 339/2 L; 339/5 A; 339/8 A

[58] Field of Search ..... 200/48 CB, 48 P, 48 R; 308/189 R; 339/2 A, 2 L, 5 A, 8 A

[56] References Cited

U.S. PATENT DOCUMENTS

| | | | |
|---|---|---|---|
| 618,132 | 1/1899 | Powdrill et al. | 308/189 R |
| 1,402,794 | 1/1922 | Reese | 308/189 R |
| 3,799,635 | 3/1974 | Worrix | 308/189 R |
| 3,879,588 | 4/1975 | Cole | 200/48 CB |

*Primary Examiner*—Brooks H. Hunt
*Attorney, Agent, or Firm*—Robert C. Jones

[57] ABSTRACT

A high voltage center break disconnect switch assembly having an integrally cast aluminum base usable as cast with provisions for shaft and gear adjustments without disassembling the switch and utilizing open stainless steel bearings.

5 Claims, 5 Drawing Figures

CENTER BREAK DISCONNECT SWITCH ASSEMBLY

BACKGROUND OF THE INVENTION

A typical high voltage switch includes contact arms swingable into and out of engagement. Such switches are located outdoors with the arms mounted on spaced apart elongated angularly orientated insulators which, in turn, are carried on a base in which is adapted to be mounted on structure above the ground.

Prior switch assemblies of the type herein set forth have many disadvantages especially when utilized in an outdoor environment and subjected to rain, sleet, snow, icing, dust, etc. For example, in center break switches the angularly orientated insulators are rotatable to effect the swinging movement of the contact arms. For this purpose the insulators are mounted on spindles which are supported in antifriction bearings disposed within the base. Since the spindles are angularly disposed in the base the problem of water seeping through the spindle support structure into the bearings is a real and serious problem. Such moisture can freeze and impair the operation of the switch at a most critical time. Also, the bearing used requires the base to be machined to provide seats for the bearings. Still another disadvantage is that the adjustment of the spindle gears requires that the switch be at least partially disassembled so that shims can be inserted. Such adjustment has always been a try and error method and effected in the field. Furthermore, gear stops if provided have been located and adjusted internally of the base, again making field adjustment difficult.

SUMMARY OF THE INVENTION

The present invention contemplates a center break disconnect switch having an improved base structure of an integrally cast aluminum unit which is usable as cast. Such structure is little subject to corrosion. Furthermore, the improved base presents includes means which provide for easier adjustment of the spindle gears in the field. In addition the improved base has provisions for an external gear stop for limiting the angular movement. The overall arrangement provides a base which is easier to manufacture as no machining other than tapping is required. The base is corrosion resistant.

DESCRIPTION OF THE INVENTION

Figure 1:
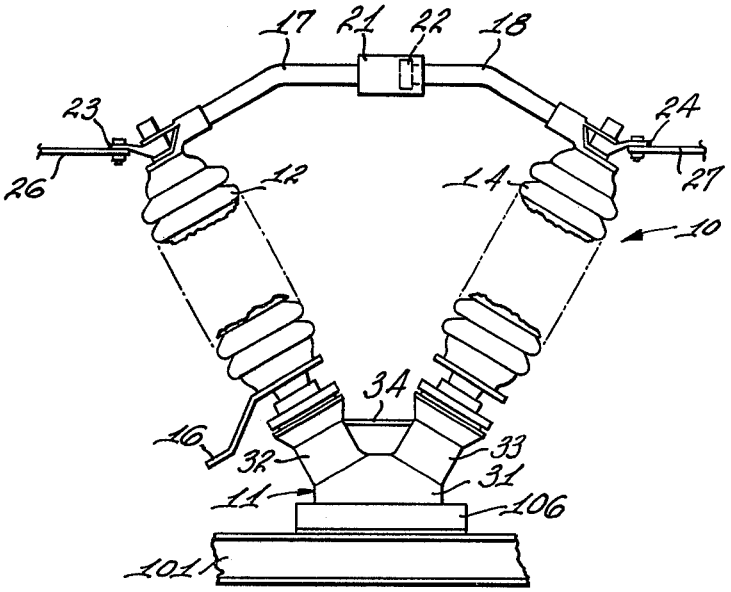
FIG. 1 is a view in front elevation of a center break disconnect switch in which the present invention is incorporated.

Referring first to FIG. 1, a center break disconnect switch 10 is therein depicted includes a base 11 on which a pair of insulators 12 and 14 are supported for angular movement about their axes. Rotation of the insulators 12–14, simultaneously in contra directions is effected through a lever arm 16 which may be connected to like mechanism associated with other disconnect switch in a three pole installation. Lever arm 16 is actuated manually or by power as may be preferred. Each of the insulators 12–14 at their upper free ends support a contact arm 17 and 18 on the inner ends of which mating contact structures 21 and 22, respectively. Terminal pads 23 and 24 are also supported at the upper ends of the insulators and are adapted to receive power lines 26 and 27, respectively, in well-known manner.

Figure 2:
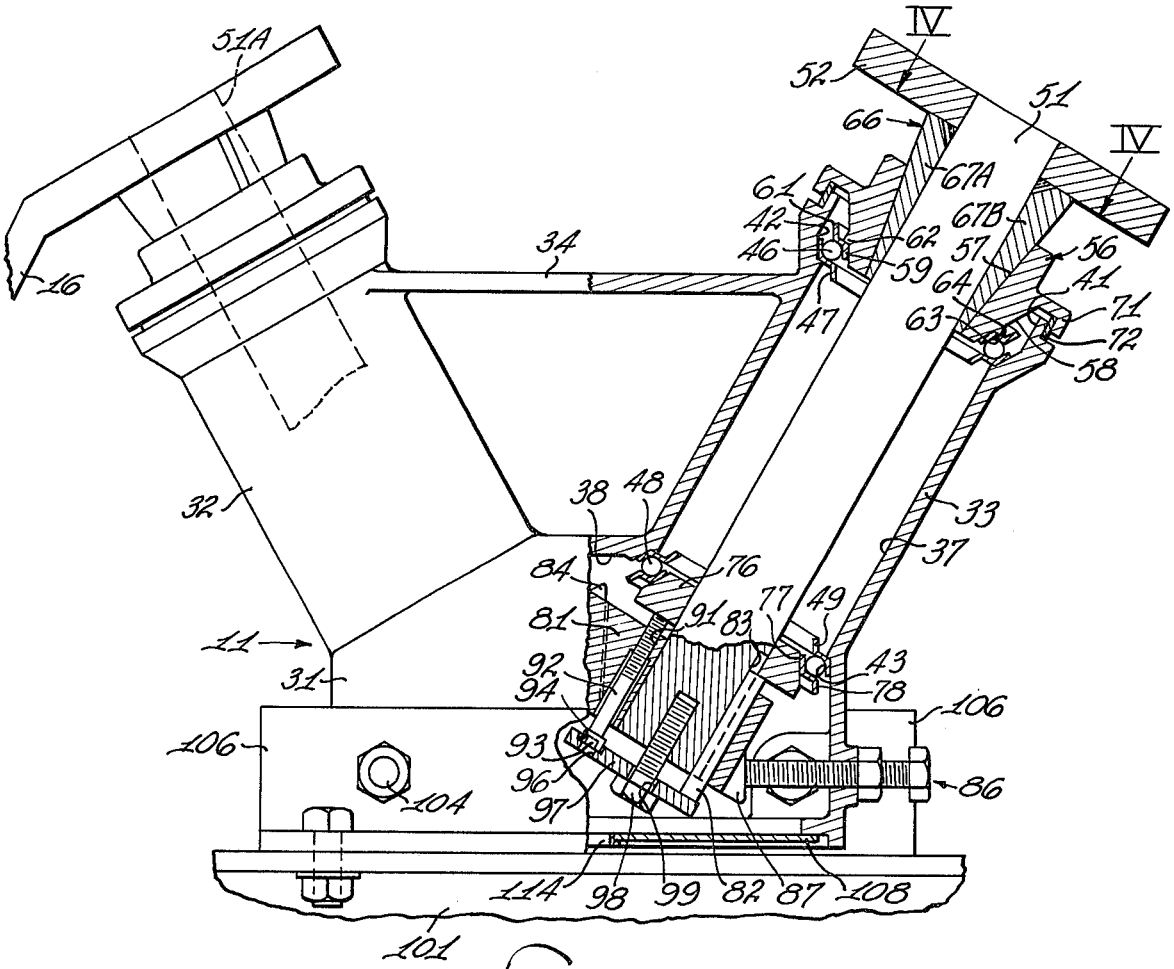
FIG. 2 is an enlarged view partly in elevation and partly in section of the improved base showing the interior arrangement of one spindle.

As shown in detail in FIG. 2, the base 11 is integrally cast of aluminum and presents a lower housing portion 31. Upstanding from the housing portion 31 are a pair of angularly inclined spindle housings 32 and 33 which are integrally cast with the housing portion 31. A transverse web 34 adds rigidity to the structure. Since the base casting 11, and associated mechanism, is the same on each side of a vertical plane which passes through the center of the base, as viewed in FIG. 2, a description of the right-hand half portion of the base will also apply to the left-half portion. As shown, the spindle housing 33 is integrally formed with the housing portion 31 and presents hollow bore 37 which communicates with the interior chamber 38 of the housing portion 31. The bore 37 has an upper or outer cast counterbore 41 which terminates in a conical seat 42. The inner or lower end of the spindle housing has a cast seat 43. An antifriction bearing 46 is disposed within the upper counterbore 41 with the inner race 47 thereof seated in the cast conical seat 42. An antifriction bearing 48 identical to the bearing 46 is located at the inner end of the spindle housing an has its inner race 49 seated in the cast seat 43. For a detailed description of the antifriction bearings 46 and 48, reference may be had to U.S. Pat. No. 3,799,635.

A spindle 51 presenting a circular support flange 52 extends through the housing 33 and is supported for rotation by the antifriction bearings 46 and 48. To this end the upper end of spindle 51 receives a bearing retainer 56 having a conical outer nose portion 58. The conical outer nose portion 58 snuggly engages in a conical ring portion 59 of the outer race 61 of the bearing 46. A circular flange 62 for the conical outer surface of the nose portion 58 presents an arcular horizontal surface 63 which is adapted to engage the horizontal surface 64 of the outer race 61 of the bearing 46. Thus, the bearing retainer 56 maintains the outer race in position thereby maintaining the entire bearing in operative position.

Figure 4:
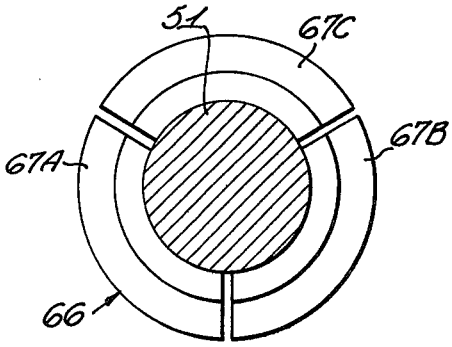
FIG. 4 is a plan view of the spindle wedges taken along line IV—IV of FIG. 2.
Figure 5:
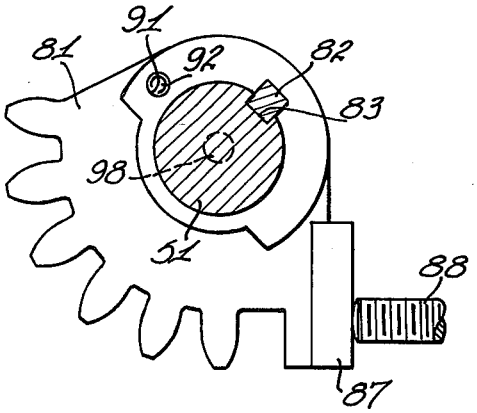
FIG. 5 is a fragmentary view of one of the gears showing the positive stop arrangement.

Inserted between the spindle 51 and the bearing retainer 56 is a collet 66 comprising three sectors 67A, 67B and 67C two of which are shown in FIG. 2 and the three shown in FIG. 4. The three sectors 67A, B and C each present semi-conical outer surfaces which are complementary to the conical bore 57 of the retainer 56. The three sector collet 66 operates to maintain the spindle 51 in concentric relationship within the bearing retainer 56 and also to remove any looseness or play between the spindle and retainer. On assembly the three sectors 67A, 67B and 67C are placed in position around the spindle 51 and the spindle is then inserted into the bearing retainer 56. The spindle enters to a controlled depth as established by the three sector collet 66. This is true because, as can be seen in FIG. 2, the end surfaces of the sectors abut the undersurface of the mounting flange 52. Thus, with the tapered relationship provided between the three sectors 67A, B and C and the bearing retainer 56 the depth of entry of the sectors into the retainer 56 is limited.

To prevent dust, water, etc. from entering into the bore 41 of the spindle housing 33, the bearing retainer 56 is formed with a radial cap 71. The cap 71 extends downwardly to encompass a circular seal 72 which is disposed on a reduced portion of the housing 33. As shown, the seal 72 extends beyond the end of the spindle housing 33 to provide a clearance space between the cap 71 and the end of the spindle housing 33. With this arrangement rotation of the bearing retainer 56 is not restricted and the seal is maintained.

The inner or lower end of the spindle 51 receives a bearing retainer 76. A conical surface formed on the bearing retainer 76 engages with a conical ring portion 77 of the outer race 78 of the bearing 48.

The engagement of the bearing retainer 76 with the outer race 78 of the bearing 48 effectively maintains the bearing in operative position.

A spindle drive gear 81 is mounted on the spindle 51 below the bearing retainer 76. A key 82 engaged in a longitudinally extending keyway 83 operatively connects the drive gear 81 to the spindle. As indicated the spindle drive gear 81 is a sector gear which meshes with a similar type gear 84 that is drivenly connected to the spindle in the housing 32. Thus, a force applied to the handle or lever 16 for rotating the insulator 12 will of course rotate the spindle 51A. This, in turn, will effect rotation of the insulator 14 in a direction opposite to the direction of rotation of the insulator 12.

To limit the angular movement of the spindles 51 and 51A and thereby the insulators 12 and 14, a positive stop means 86 is provided. To this end the sector gear 81 is provided with an outwardly extending thumb portion 87. A screw 88 is threadedly engaged in a threaded tapped opening in the end of the base 31. The threaded screw extends into the base 31 into position to engage the thumb portion 87 of the gear 81 and operates to limit the angular movement of the gear 81 in a switch opening direction of operation. Thus, adjustment of the screw 88, either inwardly or outwardly, will establish the limit of angular movement permitted to the gear 81. This, in turn, establishes the opening spread between the contact blades 17 and 18.

Alignment of the gears 81 and 84 for proper gear mesh can be accomplished after the unit is assembled. Also preloading of the bearings 46 and 48 is accomplished at the same time. To this end, the gear 81 is formed with a threaded opening 91 the axis of which is parallel to the axis of the spindle 51 on which the gear 81 is mounted. A socket head cap screw 92 is threadedly engaged in the threaded opening 91 and is adapted to engage the bearing retainer 76. The head end 93 of the screw 92 fits within a counterbore 94 of an opening 96 formed in one of the bar 97. A bolt 98 extends through an opening 99 formed in the bar 97 and into threaded engagement in the end of the spindle 51. The opposite or free end of the bar 97 engages against the extending end of the key 82. Since the gear 81 is axially movable on the end of the spindle 51, tightening the bolt 98 will force the key 82 and the socket screw 92 against the retainer 76 thereby preloading of the bearing 46. This is possible because of the conical engagement effected between the three sector collet 66 and the bearing retainer 56. Thus, the collet 66 can enter into the conical bore 57 of the retainer 56 to a predetermined depth and any additional force is transmitted to the bearing retainer 56. As stated the socket head cap screw 92 can be adjusted in the gear 81. To this end an allen wrench is insertable through the opening 96 and into engagement with head of the screw 92.

For the purpose of securing the base 31 to supporting structure such as a beam 101, the base has internal integrally casted bolt head retaining recesses 102 and associated bolt openings 103. Bolts 104 are inserted through the openings 103 and extend through aligned drilled openings provided in angle beams 106 which are bolted to the beam 101 in parallel spaced relationship.

Figure 3:
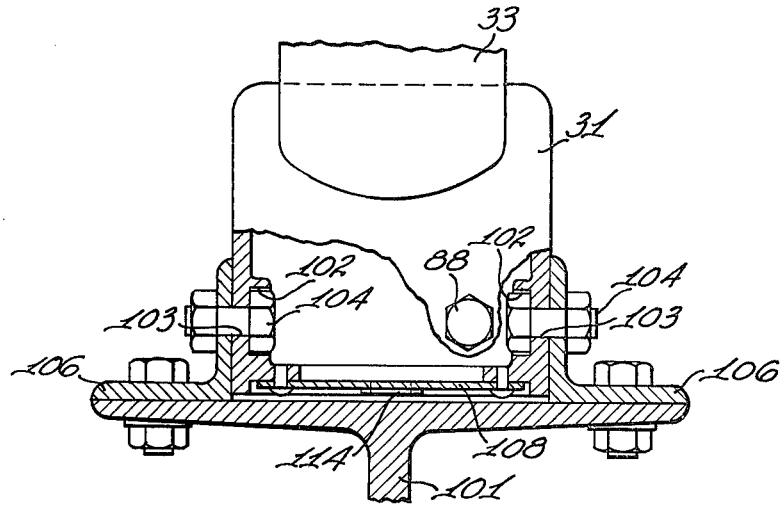
FIG. 3 is an enlarged fragmentary side view of the base with parts broken away to show the means for mounting the base to support structure.

As is well known off-ground enclosures such as the switch base 31 are attractive to birds and animal as nesting sets. Such debris interferes with the orderly and smooth operation of the switch and indeed often results in an inoperative switch. To prevent this condition in the base 31, the bottom of the base is closed by a closure plate 108 and is fitted with a plurality of vent plugs 114 one of which is shown in FIGS. 2 and 3.

The embodiments of the invention in which an exclusive property or privilege is claimed are defined as follows:

1. In a high voltage center break switch:

an integrally casted hollow metallic base presenting a pair of hollow spindle housings which extend upwardly in a common plane and away from each other, said spindle housings being identical;

antifriction bearings operably disposed in opposite ends of each of said spindle housings;

antifriction bearing seats in said spindle housings casted integrally with said base and operable as casted to receive said antifriction bearings;

a spindle journalled in the bearings associated with each spindle housing;

adjustable means operably connected to each of said spindles for preloading the associated antifriction bearings;

openings casted integrally with said base and adapted as casted to receive bolts for securing said base to supporting structure, said bolt openings including casted bolt head retaining recesses adapted as cast to receive and hold the heads of the bolts received in said opening to restrain the bolts against rotation;

a perimeter recess integrally cast with said base in the bottom edge surface thereof and adapted as casted to receive a closure plate; and, a closure plate having at least one vent operably secured in said perimeter recess to seal the said base to prevent animals and debris from entering into the interior of said hollow base.

2. In a high voltage center break switch:

an integrally casted hollow metallic base presenting a pair of hollow spindle housings which extend upwardly in a common plane and away from each other;

antifriction bearings operably disposed in opposite ends of each of said spindle housings;

a spindle journalled in the bearings associated with each spindle housing;

an upper bearing retainer having an axial opening associated with the upper end of each of said spindle housings, said upper bearing retainers being constructed and arranged to have a nose portion engageable with the outer race of an associated antifriction bearing, said upper bearing retainers also having a radial outwardly extending cup-like flange adapted to encompass the upper ends of said spindle housings to prevent entry of debris and moisture into the housings;

a spindle collet engageable about said spindles and receivable in the axial opening of said bearing retainer and operable to maintain an associate spindle in axial alignment in the spindle housing and to maintain the axial length of said spindle with said spindle housing at a predetermined relationship;

a lower bearing retainer engaged on the lower end of each of said spindles in position of engagement with the outer race of an associated lower antifriction bearing; and, adjustable means operably connected to each of said spindles and operable to engage with an associate lower bearing retainer to move the retainer along said spindle and into forceful engagement with the outer race of the associated lower antifriction bearing.

3. A high voltage center break switch according to claim 2 including a spindle drive gear engaged on the inner end of each of said spindles, said spindle drive gears being disposed in meshing engagement with each other;

a longitudinally extending keyway formed in each of said spindles, said keyways extending from the inner end of said spindles a distance sufficiently for enough to underlie said lower bearing retainer in any adjusted axial position of said lower bearing retainer;

a keyway in each of said drive gears;

a driving key engaged in the keyways of associated spindles and driving gears to establish a drive connection therebetween, said driving keys being of a length to extend beyond an associated drive gear and into engagement with the associated lower bearing retainer; and, said adjustable means being operable to effect movement of said key in said keyways to forcefully engage said key with lower bearing retainer to effect its movement into forceful engagement with the outer race of said lower antifriction bearing to thereby preload the bearing.

4. A high voltage center break switch according to claim 3 including a screw threadedly engaged in a threaded opening provided in each of said drive gears; said screws extending beyond the associated gear and into engagement with an associated lower bearing retainer;

said adjusting means operate to move said key and said screw into forceful engagement with an associated lower bearing retainer for preloading said bearings;

means connected to each of said spindles and operable to prevent axial movement of said screw upon rotation of said screw; and, means to effect rotation of said screws to thereby effect an axial adjustment of said gears on said spindles for adjusting the meshed engagement of said spindle drive gears relative to each other.

5. A high voltage center break switch according to claim 4 wherein said adjusting means associated with each of said spindles includes a bar having a first opening;

a bolt extending through the first opening in said bar into threaded engagement with the inner end of said associate spindle;

a second opening in said bar, said second opening having a counterbore adapted to receive the head portion of said screw the arrangement being such that said screw is captured between said lower bearing retainer and said bar and the second opening in said bar provides access to said screw for effecting its rotation; and, said bar also being constructed and arranged to engage with an end of said key, whereby tightening of said bolt will move said bar closer to the end of the associated spindle which thereby effects axial movement of said key and said scrw against said lower bearing retainer to effect the preloading of said bearings and said screw may be rotated to effect an axial adjustment of the associated drive gear relative to its spindle to effect proper meshed engagement of said spindle driving gears.

* * * * *